US006267561B1

(12) United States Patent
Sommars

(10) Patent No.: US 6,267,561 B1
(45) Date of Patent: Jul. 31, 2001

(54) VARIABLE DELIVERY, FIXED DISPLACEMENT PUMP

(75) Inventor: Mark F. Sommars, Sparland, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/396,185

(22) Filed: Sep. 14, 1999

Related U.S. Application Data

(60) Provisional application No. 60/124,604, filed on Mar. 16, 1999.

(51) Int. Cl.[7] ..... F04B 1/26; F04B 19/24; F04B 1/12

(52) U.S. Cl. ..... 417/222.1; 417/53; 417/269

(58) Field of Search ..... 417/222.1, 53, 417/269, 490, 507; 92/71

(56) References Cited

U.S. PATENT DOCUMENTS

| | | | | |
|---|---|---|---|---|
| 3,150,603 | | 9/1964 | Yarger | 103/174 |
| 3,249,052 | | 5/1966 | Karlak | 103/9 |
| 3,482,521 | | 12/1969 | Wolf | 103/38 |
| 4,028,015 | * | 6/1977 | Hetzel | 417/415 |
| 4,129,063 | * | 12/1978 | Ifield | 91/506 |
| 4,492,527 | | 1/1985 | Swain et al. | 417/222 |
| 4,600,364 | | 7/1986 | Nakatani et al. | 417/216 |
| 5,417,552 | | 5/1995 | Kayukawa et al. | 417/222.2 |
| 5,702,235 | | 12/1997 | Hirota et al. | 417/222.2 |
| 5,915,928 | * | 6/1999 | Murase et al. | 417/269 |

* cited by examiner

*Primary Examiner*—Charles G. Freay
*Assistant Examiner*—Michael K. Gray
(74) *Attorney, Agent, or Firm*—John J. Cheek; Michael R. Huber

(57) ABSTRACT

A variable delivery, fixed displacement pump comprises a plurality of pistons reciprocated within corresponding cylinders in a cylinder block. The pistons are reciprocated by rotation of a fixed angle swash plate connected to the pistons. The pistons and cylinders cooperate to define a plurality of fluid compression chambers each have a delivery outlet. A vent port is provided from each fluid compression chamber to vent fluid therefrom during at least a portion of the reciprocal stroke of the piston. Each piston and cylinder combination cooperates to close the associated vent port during another portion of the reciprocal stroke so that fluid is then pumped through the associated delivery outlet. The delivery rate of the pump is varied by adjusting the axial position of the swash plate relative to the cylinder block, which varies the duration of the piston stroke during which the vent port is closed.

16 Claims, 4 Drawing Sheets

VARIABLE DELIVERY, FIXED DISPLACEMENT PUMP

CROSS REFERENCE TO RELATED APPLICATION

This application claims the benefit of prior provisional patent application serial number 60/124,604 filed Mar. 16, 1999.

FEDERALLY SPONSORED DEVELOPMENT

This invention was made with Government support under the Contract No. DE-FC05-970R22605 awarded by the Department of Energy. The Government has certain rights in this invention.

TECHNICAL FIELD

This invention relates to a variable delivery, fixed displacement fluid pump and, more particularly, to a variable delivery, fixed displacement pump suitable for pressurizing actuation fluid for fluid actuated diesel engine unit injectors or other fluid actuated devices.

BACKGROUND ART

Axial, swash plate type piston pumps are well known in the art. In cases where the swash plate angle is fixed with respect to its axis of rotation, fluid delivery from the pump is dependent only upon the angular velocity of the rotating swash plate. Thus, increasing the angular velocity of the swash plate provides a higher delivery rate, and decreasing the angular velocity of the swash plate provides lower delivery rate. In certain applications, such as fluid actuated diesel injection systems, for example, the swash plate is driven directly by the engine and the angular velocity of the swash plate is dependent upon engine speed. As a result, pump delivery is dependent upon engine speed. However, there are many instances in which it is desirable to control pump delivery independent of engine speed or angular velocity of the swash plate.

To allow variable fluid delivery from the pump independent of angular velocity of the swash plate, it is well known to utilize a swash plate that can be moved to various angles relative to its axis of rotation to thereby vary the displacement of the pump. Such a pump is often referred to as a wobble plate pump. Wobble plate pumps provide satisfactory variable delivery for many applications, but they are often mechanically complex and more prone to failure.

So-called "sleeve metered" pumps have been developed to achieve the variable delivery available from wobble plate pumps without a complex mechanical pump structure. An exemplary sleeve metered pump is illustrated in U.S. Pat. No. 5,603,609, granted Feb. 18, 1997, to Kadlico. In general, sleeve metering utilizes a fixed angle swash plate, thus providing a fixed displacement pump. Each piston is provided with a radial vent port in a portion thereof that does not travel within the cylinder so that fluid is vented through the vent port during the compression stroke. A sleeve is slidably disposed around the portion of each piston that does not travel within the cylinder. As the piston moves during the compression stroke, fluid is vented through the vent port of the piston until the vent port moves through the sleeve, which closes the port. When the vent port is closed, fluid is compressed and pumped at high pressure from the cylinder through an outlet port. Thus, moving the sleeve to cover the vent port longer or shorter durations during the compression stroke varies fluid delivery from the pump. Like wobble plate pumps, sleeve metered pumps are also satisfactory for many applications, but they often require complex mechanical systems and controls to move the sleeves relative to the pistons and are thus more prone to failure.

This invention is directed to overcoming one or more of the problems or concerns set forth above.

DISCLOSURE OF THE INVENTION

In one aspect of this invention, a variable delivery, fixed displacement pump, comprises a cylinder block defining at least one cylinder and at least one piston having a portion thereof reciprocal through a stroke within the at least one cylinder. The piston and the cylinder together define a variable volume fluid compression chamber having a delivery outlet. An angled swash plate is axially spaced from the cylinder block and drivingly connected to the at least one piston to reciprocate the piston relative to the cylinder block. The swash plate rotates about a swash plate axis and disposed at a fixed angle relative to the swash plate axis. The relative axial spacing between the swash plate and the cylinder block is adjustable without changing the fixed angle of the swash plate relative to the swash plate axis of rotation.

In another aspect of this invention, the relative axial spacing between the swash plate and the cylinder block is adjusted by moving the swash plate along its axis of rotation relative to the cylinder block.

In yet another aspect of this invention, a method for controlling the delivery rate of a fixed displacement pump is disclosed. The pump has a rotatable, angled swash plate drivingly connected with at least one piston to thereby move the piston through a reciprocal stroke within a cylinder defined by a cylinder block axially spaced from the swash plate. The piston and cylinder together define a fluid compression chamber having a delivery outlet. The method comprises providing a vent port from the fluid compression chamber operable to vent fluid from the compression chamber during at least a portion of the reciprocal stroke of the piston. The piston and cylinder cooperating to close the vent port during another portion of the reciprocal stroke of the piston so that fluid within the compression chamber is pumped through the delivery outlet. The method further comprises providing relative axial motion between the swash plate and the cylinder block to adjust the axial spacing between the swash plate and the cylinder block, wherein the axial spacing between the swash plate and the cylinder block determines the duration of the another portion of the reciprocal stroke of the piston.

Other features and advantages of the present invention will be apparent from the following description and the accompanying drawings.

BEST MODE FOR CARRYING OUT THE INVENTION

Figure 1:
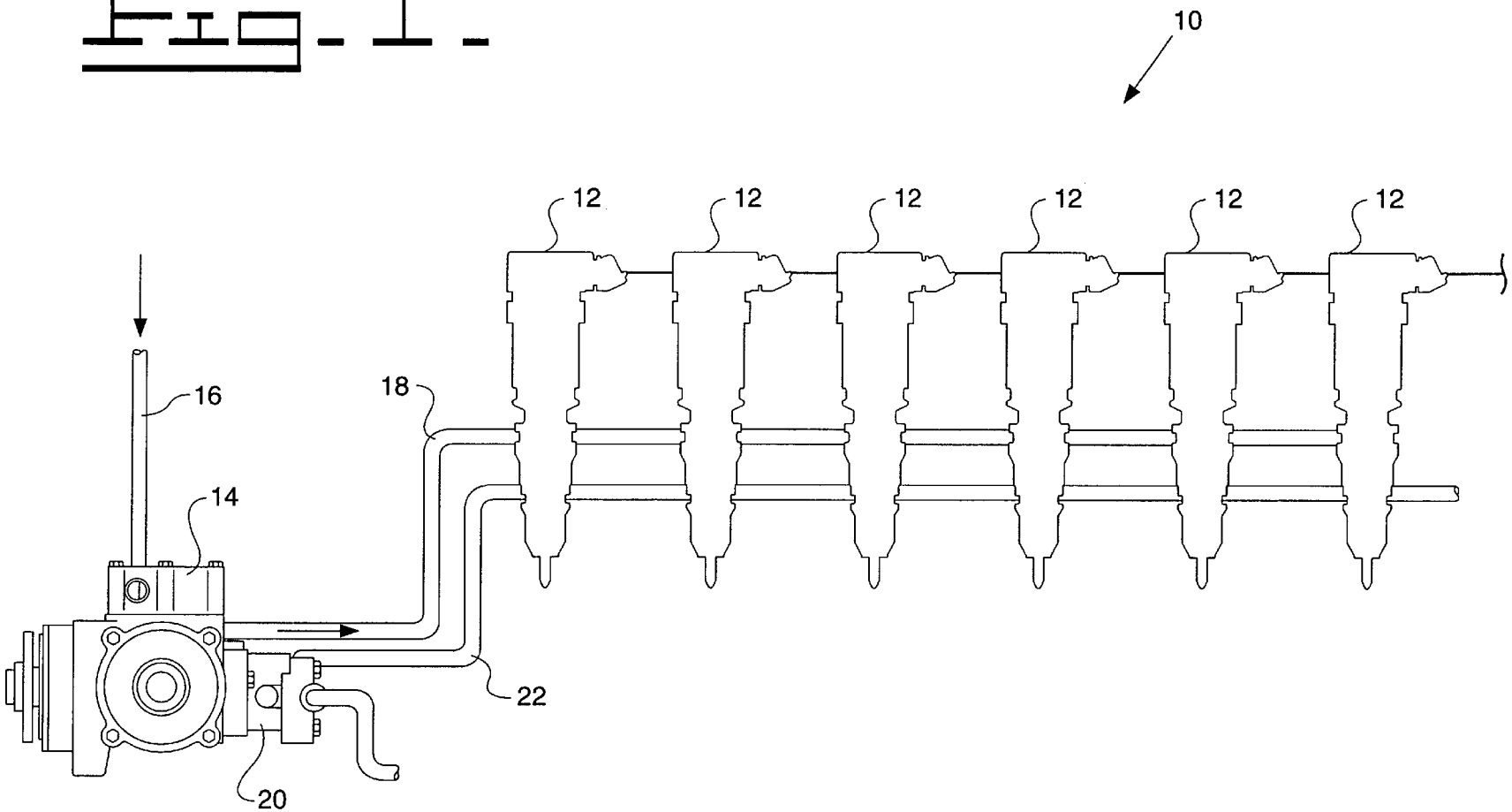
FIG. 1 is a diagrammatic view of a portion of fluid actuated diesel engine fuel injection system with which this invention may be used.

FIG. 1 diagrammatically illustrates a fluid actuated diesel fuel injection system 10 with which this invention may be used. In particular, the fuel injection system includes a plurality of fluid-actuated unit pump injectors 12 powered via a variable delivery, fixed displacement fluid pump 14 in accordance with this invention. Actuation fluid is supplied to the pump 14 via an inlet 16. High-pressure actuation fluid is supplied from the pump 14 to the unit pump injectors 12 via a common rail 18. A conventional fuel transfer pump 20 is mounted to and driven by the actuation fluid pump 14 and supplies fuel to the unit pump injectors 12 via a common fuel rail 22. The fuel system 10 illustrated in FIG. 1 is preferably a HEUI™ fuel system available from Caterpillar Inc. An example of such a HEUI™ fuel system is described in greater detail in commonly-owned U.S. Pat. No. 5,515, 829.

Figure 2:
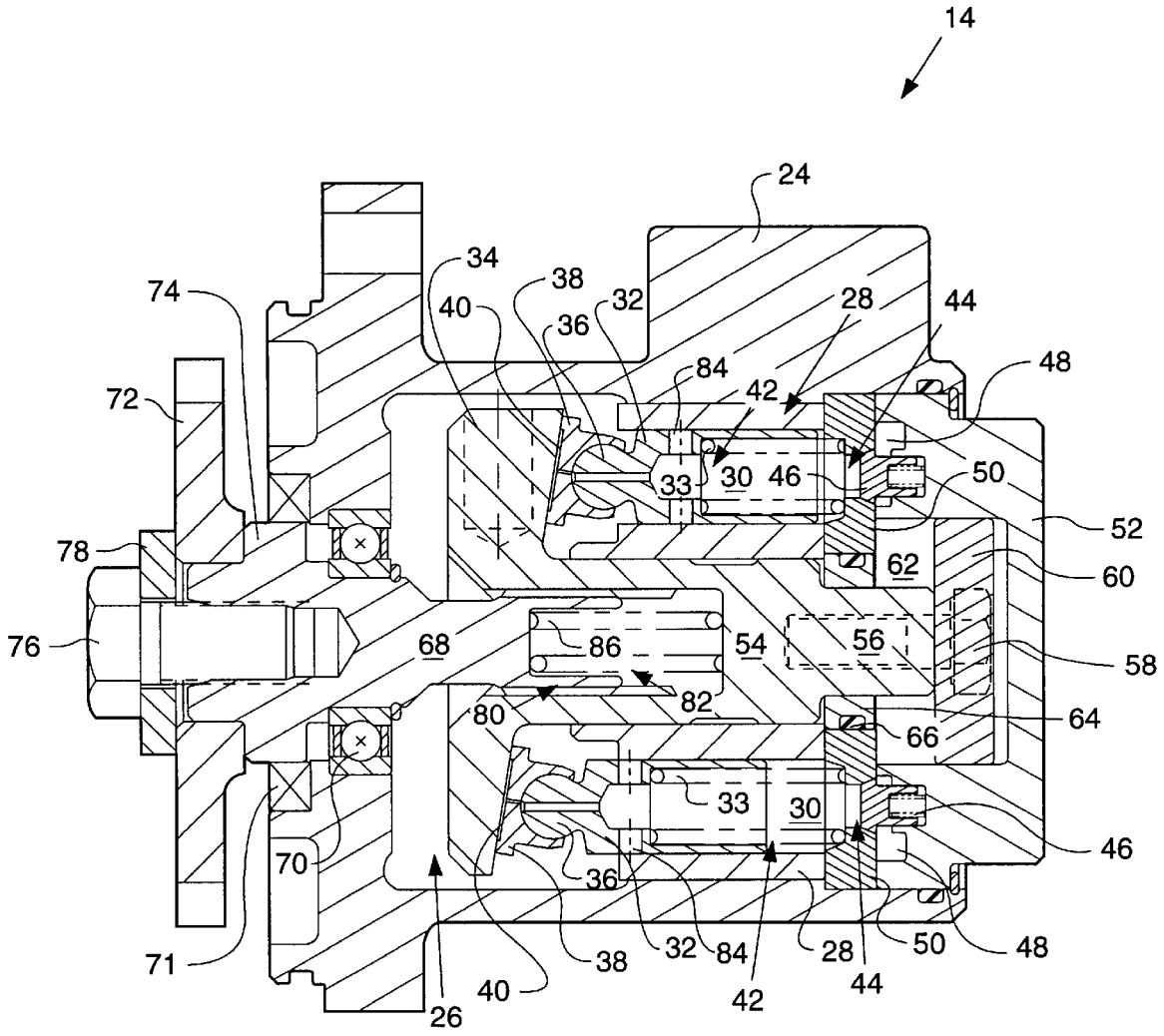
FIG. 2 is a cross-sectional view showing a fixed displacement, variable delivery fluid pump in accordance with this invention in its maximum delivery configuration.

With reference now FIG. 2, the actuation fluid pump 14 is generally an axial, swash plate-type piston pump. The pump 14 comprises a pump body or housing 24 in which is mounted a pump assembly, generally designated 26. The pump assembly 26 includes a barrel or cylinder block 28 that defines a plurality of cylinders 30 therein. Each cylinder has slidably received therein a portion of a piston 32, and a spring 33 is trapped between each piston 32 and the base of its corresponding cylinder 30. Each piston is connected at one end by a spherical mounting arrangement to a fixed angle swash plate 34. More particularly, each piston 32 includes a spherical head 36 received within socket in a shoe 38 slidably mounted to the swash plate 34 by a hydrostatic bearing 40. The construction of the pump 14 thus far described is conventional and well known in the art. As the swash plate 34 rotates, the pistons 32 are caused to move through a reciprocal stroke within the cylinders 30. As the pistons move to the right in FIG. 2, the compression stroke is taking place. As the piston, move to the left in FIG. 3, the expansion or intake stroke is taking place.

The cylinders 30 and the pistons 32 cooperate to define a plurality of variable volume fluid compression chambers 42. Each fluid compression chamber 42 has a delivery outlet 44 that is closed during the intake stroke by a conventional spring-biased check valve 46. Each fluid compression chamber 42 also has a fluid inlet (not shown) to allow fluid to be drawn into the chamber 40 during the intake stroke. The fluid inlet preferably is a port (not show) offset from the delivery outlet 44 and closed during the compression stroke by a conventional spring-biased check valve (shown) located away from the axis of the cylinder 30. Although not shown, the fluid inlet to the cylinders 30 may be in any other suitable manners, such as an inlet slot in the swash plate 34 that opens to ports in the heads 36 of the piston 32. The delivery outlets 44 each open to a common delivery gallery 48 in fluid communication with the outlet of the pump 14. As apparent from FIG. 2, the delivery outlets 44 are defined by a plate-like ring 50 covering the ends of the cylinder 30. An end cap 52 is secured to the pump housing 24 and has mounted thereto the check valves 46. The end cap 52 also defines the delivery gallery 48.

With continued reference to FIG. 2, the swash plate 34 is integral with a rotatable drive shaft 54 extending through the center of the cylinder block 28. The radial inner surfaces of the cylinder block 28 that engage the drive shaft 54 are preferably suitable journal bearing surfaces, since those surfaces bear radial loads from the drive shaft 54. The drive shaft 54 includes a rod-like portion 56 that is connected, as by bolt 58, to an adjustment piston 60 disposed in an adjustment cylinder 62 defined by the end cap 52. The adjustment cylinder 62 is sealed by a floating seal 64, which includes an 0-ring seal 66 The radially inwardly facing surface of the adjustment cylinder 62 that bear against the radially outwardly facing surface of the adjustment piston 60 are preferably suitable journal bearing surfaces since they bear radial loads from the adjustment piston 60.

A rotatable input shaft 68 is mounted at the opposite end of the pump housing 24 in an axially fixed position by a suitable bearing 70 and an annular seal 71. An input drive gear 72 is secured to the outer end 74 of the input shaft 68, as by bolt 76 and washer 78. The inner end 80 of the input shaft 68 is received within a counterbore 82 provided in the integral swash plate 34 and drive shaft 54. Outwardly projecting splines on inner end 80 of the input shaft 68 mate with inwardly projecting splines in the counterbore 82. Consequently, rotation of the input shaft 68, via gear 72, is transmitted to the drive shaft 54 and thus to the swash plate 34. Moreover, the splined connection between the drive shaft 54 and the input shaft 68 permits the drive shaft 54 (and thus the swash plate 34) to slide axially relative to the input shaft 68 and the cylinder block 28.

Each fluid compression chamber 42 has a vent port 84 opening therefrom. As will be described, the vent ports 84 are operable to vent fluid from the fluid compression chambers 42 during a portion of the reciprocal stroke of the piston 32. In the embodiment illustrated in FIG. 2, each piston 22 has one or more radially opening vent ports 84 provided therein. However, as will be apparent from the details provided herein and as will be discussed below, the vent ports 84 may instead be provided in the walls of the cylinder block 28.

Industrial Applicability

In operation, the input shaft 68 is rotatably driven via the drive gear 72, as by an engine (not shown). Rotation of the input shaft 68 is transmitted to the drive shaft 54 and thus to the swash plate 34 integral therewith. As apparent, rotation of the drive shaft 54 causes the pistons 32 to travel through reciprocal strokes within the cylinders 30. The pump 14 is shown in a configuration in FIG. 2 in which the vent ports 84 are always within the cylinders 30 and thus remain closed throughout the entire reciprocal stroke of the pistons 32. The configuration shown in FIG. 2 is a maximum delivery configuration because fluid is pumped through the delivery outlet 44 associated with each compression chamber 42 to the delivery gallery 48 during the entire duration of each compression stroke of the pistons 32.

Figure 4:
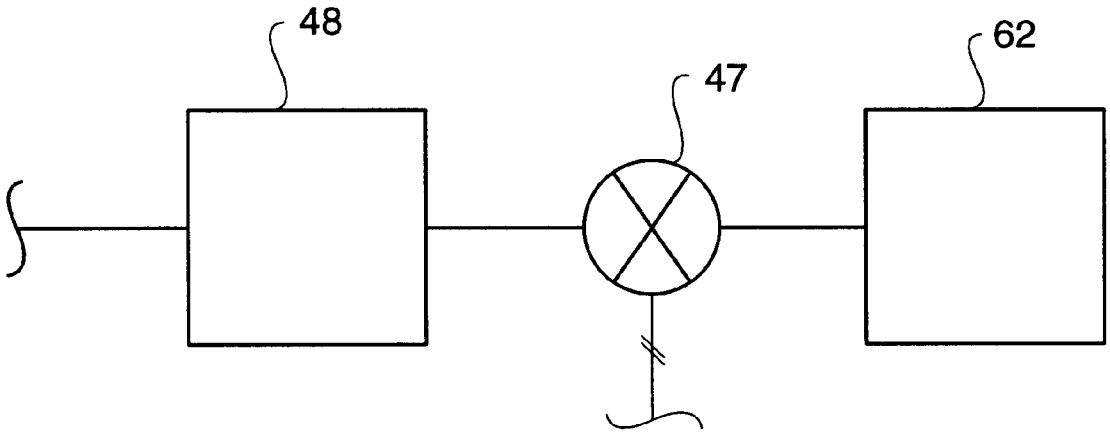
FIG. 4 is a block diagram showing the relationship between a delivery gallery and an adjustment piston of a pump in accordance with this invention.

The swash plate 34 is maintained in the maximum delivery configuration of FIG. 2 by transferring a controlled amount of the flow from the delivery gallery 48 to the adjustment cylinder 62 via a passageway (not shown) in the end cap 52. Pressure from the fluid supplied to the adjustment cylinder 62 applies a force the adjustment piston 60 toward the right in FIG. 2. Flow of fluid into the adjustment cylinder 62 is controlled by a suitable electronically-controlled valve, 47 which may be conventional and is not discussed in further detail for reference, however, FIG. 4 illustrates the relationship between the delivery gallery 48, the adjustment cylinder 62, and the control valve 47.

When it is desirable to adjust the delivery rate from the pump 14, the flow of fluid to the adjustment cylinder 62 is decreased, thereby reducing the force applied to the adjustment piston 60. The reduced force applied to the adjustment piston 60 allows the pumping forces from the pistons 32 and the force of spring 33 to drive swash plate 34, drive shaft 54, and adjustment piston 60 to the left in FIG. 2, toward a configuration shown in FIG. 3. As the swash plate moves to the left in FIG. 2, the displacement of each piston 32 does not change but the effective duration of its compression stroke is reduced because the vent ports 84 are outside of the cylinders 30 during the initial part of each compression stroke. As a result, during the initial part of each compression stroke, fluid is vented through the vent ports 84 instead of being pumped through the delivery outlets 44, which are closed by check valves 46.

Figure 3:
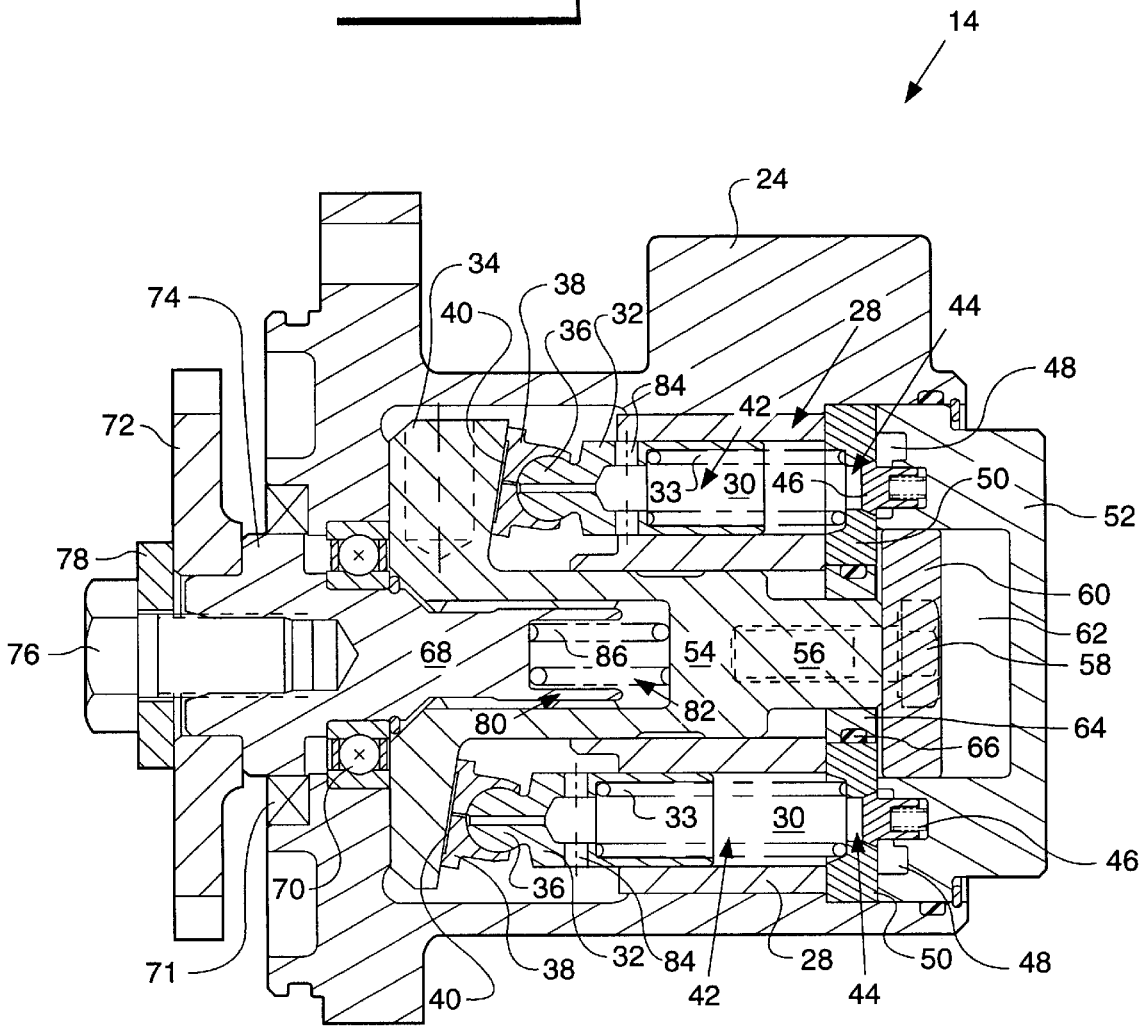
FIG. 3 is a cross-sectional view similar to FIG. 2 but showing the pump in it minimum delivery configuration.

FIG. 3 illustrates a zero delivery configuration of the pump 14, in that no fluid is pumped to the delivery gallery when the pump is configured as shown in FIG. 3 because the vent ports 84 are never completely closed by the walls of the cylinders 30. Thus, fluid is never pumped to the delivery gallery 48 when the pump 14 is configured as shown in FIG. 3. Delivery from the pump 14 can be varied infinitely between maximum delivery (FIG. 2) and zero delivery (FIG. 3) by providing relative motion between the fixed-angle swash plate 34 and the cylinder block 28 along the axis of rotation of the swash plate 34 to thereby vary duration during the compression stroke that the vent ports 84 are closed by walls of the cylinders 30. In other words, this relative motion between the swash plate 34 and the cylinder block 28 effectively varies the location of the starting position for each piston stroke relative to the cylinder block 28 and thus the portion of each stroke that the vent ports 84 remain open.

Because pumping forces from the pistons 32 and the forces from springs 33 tend to drive the swash plate 34 to the zero delivery configuration of FIG. 3 absent application of proper force to the adjustment piston 60, it is important that the swash plate 34 return to a non-zero delivery position when pump operation is interrupted, as during shut down of the pump 14. If the pump is in a zero delivery configuration at start up, no fluid will be supplied to the delivery gallery 48 and thus no fluid will be supplied to the adjustment cylinder 62. Consequently, the pump would not be able to be adjusted to a non-zero delivery configuration. To address this potential problem, a compression spring 86 or other suitable bias member is trapped between the drive shaft 54 and the input shaft 68 to bias the shafts 54 and 68 apart. As a result, the spring 86 causes the drive shaft 54 and thus the swash plate 34 integral therewith to be driven to the maximum delivery configuration shown in FIG. 2 when pump operation is interrupted.

As mentioned above, one skilled in the art will recognize that vent ports 84 may be provided in the walls of the cylinders 30 instead of in the pistons 32 without substantially changing the operation of the pump 14. In addition, one skilled in the art will also recognize that the number of pistons and cylinders is not critical, and that this invention may be practiced with plural pistons and cylinders as shown or with only a single piston and cylinders. Moreover, although it is preferred to move the swash plate 34 relative to the cylinder block 28, one skilled in the art will recognize that the same functional result can be achieved in a similar manner by moving the cylinder block 28 relative to the swash plate 34.

Although the presently preferred embodiments of this invention have been described, it will be understood that within the purview of the invention various changes may be made within the scope of the following claims.

What is claimed is:

1. A variable delivery, fixed displacement pump, comprising:

a cylinder block defining at least one cylinder;

at least one piston having a portion thereof reciprocal through a stroke within said at least one cylinder, said piston and said cylinder together defining a variable volume fluid compression chamber having a delivery outlet;

a vent port from the fluid compression chamber operable to vent fluid from the fluid compression chamber during at least a portion of the reciprocal stroke of said piston; and an angled swash plate drivingly connected to said at least one piston to reciprocate said piston relative to said cylinder block, said swash plate rotating about a swash plate axis and disposed at a fixed angle relative to the swash plate axis, said swash plate being axially movable relative to said cylinder block along the swash plate axis.

2. The pump of claim 1 wherein said piston and said cylinder cooperate to close said vent port during another portion of the reciprocal stroke of said piston so that fluid within the fluid compression chamber is pumped through the delivery outlet during the another portion of the reciprocal stroke of said piston.

3. The pump of claim 1 wherein the vent port is in said piston.

4. The pump of claim 3 wherein said vent port opens radially from said piston.

5. The pump of claim 1 further comprising a mechanism for moving said swash plate relative to said cylinder block, including an adjustment piston disposed for reciprocal movement within an adjustment cylinder and connected with said swash plate so that movement of said adjustment piston within said adjustment cylinder moves said swash plate along said swash plate axis.

6. The pump of claim 5 further comprising an input shaft and a drive shaft connecting said swash plate with said adjustment piston, wherein said drive shaft is connected with said input shaft for rotation therewith.

7. The pump of claim 6 wherein said drive shaft and said input shaft are connected by a slidable, splined connection.

8. The pump of claim 6 further comprising a bias member disposed between said drive shaft and said input shaft for biasing said drive shaft and said input shaft apart.

9. A method for controlling the delivery rate of a fixed displacement pump having a rotatable, angled swash plate drivingly connected with at least one piston to thereby move said piston through a reciprocal stroke within a cylinder defined by a cylinder block axially spaced from said swash plate, said piston and cylinder together defining a fluid compression chamber having a delivery outlet, said method comprising:

providing a vent port from said fluid compression chamber operable to vent fluid from said compression chamber during at least a portion of the reciprocal stroke of said piston, said piston and cylinder cooperating to close said vent port during another portion of the reciprocal stroke of said piston so that fluid within the compression chamber is pumped through the delivery outlet; and providing relative axial motion between said swash plate and said cylinder block to adjust the axial spacing between said swash plate and said cylinder block, wherein the axial spacing between said swash plate and said cylinder block determines the duration of said another portion of the reciprocal stroke of said piston.

10. The method of claim 9 wherein said swash plate is connected for movement with an adjustment piston disposed within an adjustment cylinder, and wherein said adjusting step comprises adjusting the position of said adjustment piston within said adjustment cylinder.

11. The method of claim 9 wherein the step of providing relative axial motion comprising moving said swash plate axially relative to said cylinder block.

12. The method of claim 9 wherein the vent port is in said piston in fluid communication with the fluid compression chamber.

13. The pump of claim 12 wherein said vent port opens radially from said piston.

14. The method of claim 10, wherein the step of adjusting the position of said adjustment piston comprises receiving fluid from said compression chamber.

15. The method of claim 10 wherein said adjustment piston is connected to said swash plate by a drive shaft.

16. A variable delivery, fixed displacement pump, comprising:

a cylinder block defining at least one cylinder;

at least one piston having a portion thereof reciprocal through a stroke within said at least one cylinder, said piston and said cylinder together defining a variable volume fluid compression chamber having a delivery outlet;

a vent port from the fluid compression chamber operable to vent fluid from the fluid compression chamber during at least a portion of the reciprocal stroke of said piston; and an angled swash plate axially spaced from said cylinder block and drivingly connected to said at least one piston to reciprocate said piston relative to said cylinder block, said swash plate rotating about a swash plate axis and disposed at a fixed angle relative to the swash plate axis, the relative axial spacing between said swash plate and said cylinder block being adjustable without changing the fixed angle of said swash plate relative to the swash plate axis of rotation.

* * * * *